United States Patent [19]

Jefferys et al.

[11] Patent Number: 4,763,775

[45] Date of Patent: Aug. 16, 1988

[54] CIGARETTE FILTER ROD FEED MECHANISM

[75] Inventors: Keith Jefferys, Richmond, Va.; Clifford R. Marritt, Winston Salem, N.C.; Albert D. Seim, II, Richmond, Va.

[73] Assignee: Molins Machine Co., Inc., Richmond, Va.

[21] Appl. No.: 897,278

[22] Filed: Aug. 18, 1986

[30] Foreign Application Priority Data

Aug. 17, 1985 [GB] United Kingdom ..... 8520663

[51] Int. Cl.[4] ..... B65G 47/19

[52] U.S. Cl. ..... 198/533; 131/282; 221/200

[58] Field of Search ..... 198/533; 221/200; 222/200; 131/94, 282, 280, 283

[56] References Cited

U.S. PATENT DOCUMENTS

| | | | |
|---|---|---|---|
| Re. 31,777 | 12/1984 | Carascon et al. | 198/573 X |
| 3,224,451 | 12/1965 | Dearsley | 131/280 |
| 3,485,208 | 12/1969 | Hemming et al. | 131/282 X |
| 3,976,085 | 8/1976 | Hall | 131/283 |
| 4,063,633 | 12/1977 | Hall | 198/533 X |
| 4,084,685 | 4/1978 | Hollenton et al. | 131/94 X |

FOREIGN PATENT DOCUMENTS

| | | | |
|---|---|---|---|
| 1009086 | 5/1957 | Fed. Rep. of Germany | 131/282 |
| 2826539 | 1/1979 | Fed. Rep. of Germany | 131/282 |

*Primary Examiner*—Jerome W. Massie
*Assistant Examiner*—Hoang C. Dang
*Attorney, Agent, or Firm*—Antonelli, Terry & Wands

[57] ABSTRACT

A filter rod feed comprises a fluted drum (10), a hopper (14) from which filter rods are arranged to be fed into the flutes of the drum, means (16, 18) for delivering pneumatically-fed filter rods into the hopper, an agitator (20, 22) comprising a substantially horizontal row of laterally spaced bars (20) in the hopper, the bars being parallel to the filter rods and being at or above the level at which pneumatically-fed filter rods are delivered into the hopper, and the arrangement being such that movement of the bars promotes a substantially even flow of filter rods between the bars in both upward and downward directions.

18 Claims, 1 Drawing Sheet

CIGARETTE FILTER ROD FEED MECHANISM

This invention is concerned with the feeding of filter rods used in the manufacture of filter cigarettes. Part of the rod feeding process involves filling the flutes of a fluted drum reliably with filter rods received from a rod hopper. The rods are usually fed pneumatically into the hopper, and there is preferably also provision for alternatively feeding rods into the hopper from trays when the pneumatic feed is inoperative.

Examples of filter feed arrangements previously proposed are described in our U.S. Pat. No. Re. 31,777, which in turn refers to earlier proposals. Details of the pneumatic feed arrangement may be, for example, as described in our British Patent Specification No. 1561560.

According to the present invention, a filter rod feed comprises a fluted drum, a hopper from which filter rods are arranged to be fed into the flutes of the drum, means for delivering pneumatically-fed filter rods into the hopper, an agitator comprising a substantially horizontal row of laterally spaced bars in the hopper, the bars being parallel to the filter rods and being at or above the level at which pneumatically-fed filter rods are delivered into the hopper, and the arrangement being such that movement of the bars promotes a substantially even flow of filter rods between the bars in both upward and downward directions.

During use, upward movement of filter rods between the bars will occur when the fluted drum stops rotating (the filter attachment machine having been switched off) and while filter rods continue to be supplied into the hopper by the pneumatic feed means in order to fill or substantially fill the space in the hopper above the bars in preparation for a resumption of operation of the filter attachment machine; filter rods may be fed into the hopper automatically at this stage in order to create a sufficient reserve of filters in the hopper. Downward movement of the filter rods between the bars occurs, for example, when the pneumatic feed is temporarily inoperative while the filter attachment machine is in use, filter rods being drawn at this stage entirely from the reserve in the space above the bars. That space may be partly defined by a tray in a system which allows for tray feeding of filter rods when the pneumatic feed is inoperative.

The hopper is preferably above the fluted drum. However, it may alternatively be to one side of the fluted drum as described in the above-mentioned U.S. Pat. No. Re. 31,777. In the former case, the agitator bars help to keep the filter rods loose and mobile in the area below the bars and adjacent to the fluted drum, thus helping to ensure that the flutes of the drum are all filled.

The presence of the agitator bars, which preferably reciprocate slowly in a horizontal direction, also helps to ensure that filter rods pass evenly downwards at various positions across the hopper; that is to say, avoiding any tendency for the upper surface of the rods in the hopper to tilt significantly with a consequent risk of rods rolling and becoming skew. This is particularly important in the case of a filter rod feed including a tray feeding provision; when a new tray full of rods is placed in position, it is desirable that the rods drop from the tray on to a rod surface below it which is substantially level, again to reduce the risk of rods becoming skew. Maintenance of a substantially level upper surface of rods in the tray also helps in optimising the use made of the tray capacity as a buffer while the filter attachment machine is inoperative and the pneumatic feed continues.

An example of a filter rod feed according to this invention is shown in the accompanying drawings. In these drawings.

Figures 1, 2:
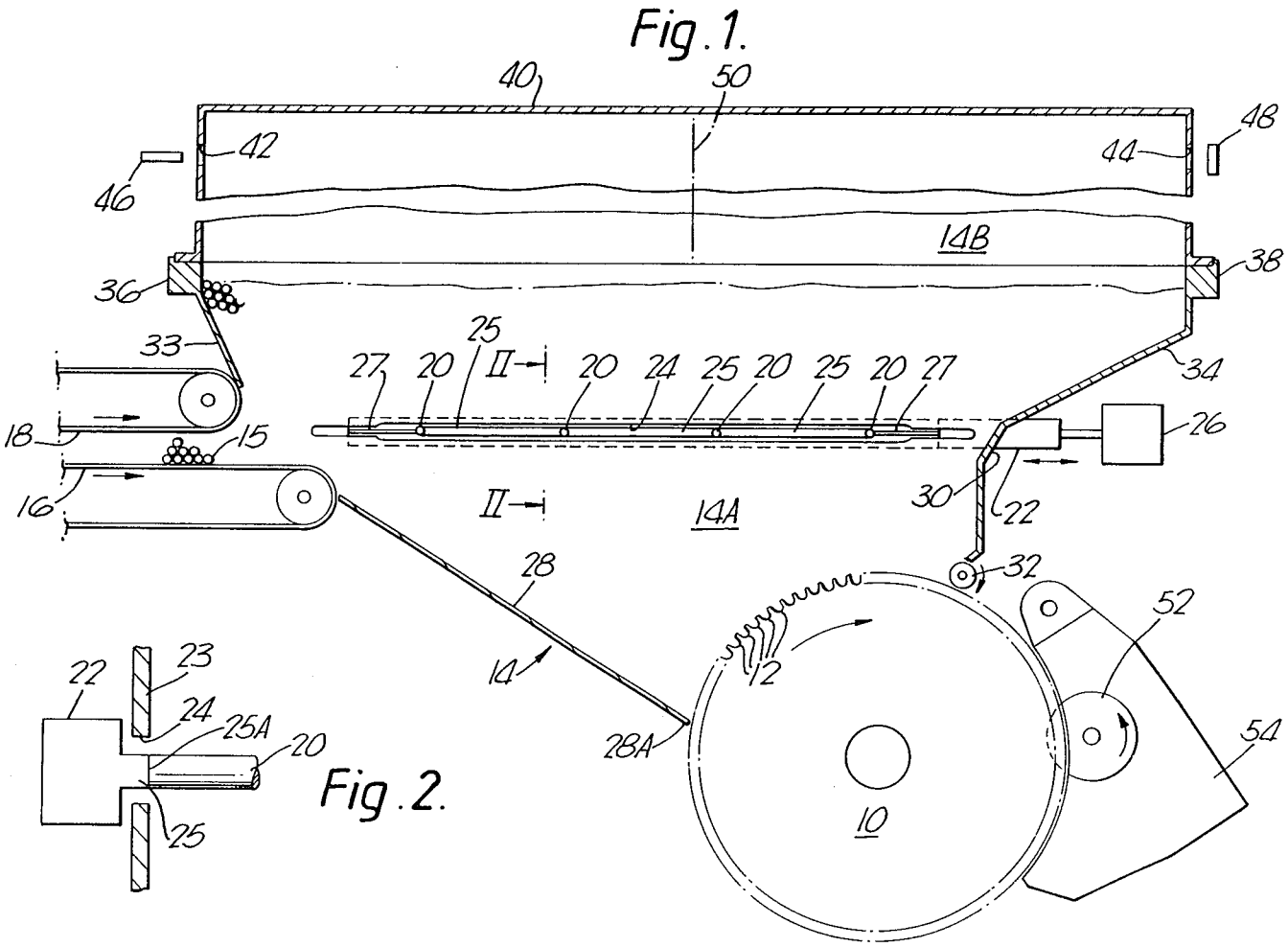
FIG. 1 is a sectioned diagrammatic front elevation.
FIG. 2 is a section on the line II—II in FIG. 1.

The arrangement shown in the drawing includes a fluted drum 10 formed with flutes 12 arranged to receive filter rods from a hopper 14 lying generally above the drum 10. Filter rods 15 are normally delivered into the hopper as a multi-layer stream by conveyors 16 and 18 from a receiving device forming part of a pneumatic feed system (not shown); the pneumatic feed system may be generally as described in the above-mentioned British Patent Specification.

It should be noted that the spaces between the rods 20 are considerably larger than the diameter of the filter rods.

The hopper includes spaces 14A and 14B lying respectively below and above a horizontal row of agitator bars 20. These bars are carried in cantilever fashion by a horizontal member 22 lying behind a rear wall 23 of the hopper, the bars 20 being arranged to project through a slot 24 in the rear wall. The bars are of circular cross-section of diameter slightly smaller than the diameter of the filter rods. Between the bars the member 22 is formed with ribs 25 which extend into the slot and have outer surfaces 25A which are flush with the inner surface of the wall 23 of the hopper. The ribs 25 prevent filter rods from passing through the slot 24. Narrower end ribs 27 fulfil a similar function, the ends of the slot 24 in the wall 23 being correspondingly narrower than the remainder of the slot.

Suitable linear bearings (not shown) are provided for the member 22 to enable it to reciprocate horizontally. A slow reciprocatory drive to the member 22 is provided by a drive mechanism 26, for example at about 1 cycle per second. The stroke may be approximately 6 cm but may be set at a lower value.

The left and right hand sides of the lower part of the hopper are formed by walls 28 and 30 respectively. It should be noted that the wall 28 is substantially straight and extends obliquely downwards from the downstream end of the conveyor 16 to a point 28A lying at a level slightly above that of the centre line of the drum 10. At the lower end of the wall 30, adjacent to the drum 10, there is a refuser roller 32 which rotates in a clockwise direction so as to drive back any filter rod tending to move forward with the drum 10 while not being contained in a flute; the action of the refuser roller is facilitated by the condition of the rods resulting from the agitator bars.

A lower part of the upper space 14B in the hopper is defined by fixed side walls 33 and 34. At the upper ends of these walls there are parts 36 and 38 for supporting a tray 40 of which the interior forms an upper part of the hopper space 14B. During normal operation of the machine with pneumatically fed filter rods, the level of the rods is maintained approximately in the region of apertures 42 and 44 in the tray; that is to say, the tray is kept nearly full. A beam of light is transmitted through the apertures from a light source 46 towards a light sensitive device 48. The arrangement is such that pneumatically-fed filter rods are conveyed into the hopper by the conveyors 16 and 18 as long as the beam of light from the source 46 reaches the device 48; that is to say, is not interrupted by the filter rods.

In the event of the pneumatic feed stopping while the filter attachment machine continues to operate, filter rods drain from the tray, the flow (and consequently the upper surface of the rods) being maintained substantially even by the agitator bars 20. When the tray is completely empty, a detector (not shown) indicates that fact and it is then necessary for the machine operator to replace the empty tray with a full tray. However, if the pneumatic feed resumes before the tray has completely emptied, the rate at which filters enter the hopper from the pneumatic feed is sufficient to fill the tray gradually even when the filter attachment machine is in operation.

It should be noted that the vertical centre-line 50 of the tray 40 is approximately in line with the point 28A at which most filters enter the flutes of the drum. This helps to ensure that filters do not drain more quickly from one side of the tray than from the other side.

Each filter rod carried by the drum 10 is cut through the middle by a disc knife 52; alternatively, there may be two such knives for cutting each filter rod into three equal portions. In addition to suction ports which hold the filter rods in the flutes of the drum, one or more stationary "anti-spin fingers" 54 are provided to restrain any tendency for the filter rods to spin in the flutes while being cut; until the rods have settled properly in the flutes, suction is not applied to the ends of the rods as we have found that can result in a rod being gripped at one end in a skew condition.

Hitherto it was common for the flutes to have a depth equal to or slightly greater than the rod diameter, and the drum periphery was recessed to allow the anit-spin fingers to engage the filter rods on both sides of the knife. However, we have now found that it is better to use shallower flutes so that the filter rods protrude slightly from them and can be engaged by the anti-spin fingers without requiring recessing of the drum periphery.

We claim:

1. A filter rod feed for a filter attachment machine comprising a fluted drum, a hopper from which filter rods are arranged to be fed into the flutes of the drum, means for delivering filter rods into the hopper, an agitator comprising a substantially horizontal row of laterally spaced bars in the hopper, the bars being parallel to the filter rods and being at or above the level at which filter rods are delivered into the hopper, and the arrangement being such that movement of the bars promotes a substantially even flow of filter rods between the bars in both upward and downward directions.

2. A filter rod feed according to claim 1 in which the agitator is arranged to reciprocate in a substantially horizontal direction.

3. A filter rod feed according to claim 2, in which the agitator reciprocates at approximately 1 cycle per second.

4. A filter rod feed according to claim 1 in which the means for delivering filter rods into the hopper comprises spaced conveyors arranged to deliver a multi-layer stream of filter rods into the hopper, the agitator being located at approximately the level of the upper conveyor.

5. A filter rod feed according to claim 1 in which the rods are carried in cantilever fashion by a bar and project into the hopper through a slot formed in a wall of the hopper.

6. A filter rod feed according to the claim 1 in which the spaces between the rods of the agitator are larger than the diameter of the filter rods.

7. A filter rod feed according to claim 1 in which a part of the hopper space above the agitator is arranged to be formed by a replaceable tray whereby filter rods can continue to be fed while the pneumatic feed is inoperative.

8. A filter rod feed according to claim 7 including photo-electric means for directing a beam of light through apertures in the tray for detecting the height of the mass of filter rods in the tray and for controlling the filter rod delivery means in response thereto.

9. A filter rod feed according to claim 7 in which the hopper includes a sloping wall for guiding filter rods towards a position at which filter rods can first enter the flutes of the drum, that position being approximately aligned with the vertical centre line of the tray.

10. A filter rod feed for a filter attachment machine comprising a flute drum, a hopper from which filter rods are arranged to be fed into the flutes of the drum means including parallel conveyors for delivering filter rods into the hopper through an opening in one side of the hopper, and an agitator comprising a substantially horizontal row of laterally spaced bars in the hopper, the bars being parallel to the filter rods and being positioned at or above the level at which filter rods are delivered into the hopper by the parallel conveyors, so that at least some of the rods delivered by the parallel conveyors enter directly into the hopper below the bars, the arrangement being such that movement of the bars promotes a substantially even flow of filter rods between the bars in both upward and downward directions.

11. A filter rod feed according to claim 10 in which the agitator is arranged to reciprocate in a substantially horizontal direction.

12. A filter rod feed according to claim 10 in which the spaced conveyors for delivering filter rods into the hopper are arranged to deliver a multi-layer stream of filter rods into the hopper, the agitator being located at approximately the level of the upper conveyor.

13. A filter rod feed according to claim 10 in which the rods are carried in cantilever fashion by a bar and project into the hopper through a slot formed in a wall of the hopper.

14. A filter rod feed according to claim 10 in which a part of the hopper space above the agitator is arranged to be formed by a replaceable tray whereby filter rods can continue to be fed while the pneumatic feed is inoperative.

15. A filter rod feed for a filter attachment machine comprising a fluted drum, a hopper having a lower end from which filter rods are arranged to be fed into the flutes of the drum, an agitator positioned in said hopper so as to extend substantially horizontally at least partially across said hopper, and means for feeding filter rods into said hopper below said agitator so that such filter rods may pass directly to said fluted drum through said hopper or move upwardly in said hopper and pass said agitator, whereby the upper surface of the rods in said hopper is maintained substantially level by said agitator.

16. A filter rod feed according to claim 15, wherein said agitator comprises a substantially horizontal row of laterally spaced bars mounted for reciprocating movement in a substantially horizontal direction and being disposed parallel to the filter rods in said hopper.

17. A filter rod feed for a filter attachment machine comprising a fluted drum, a hopper having a lower end from which filter rods are arranged to be fed into the flutes of the drum, means for feeding filter rods into said hopper through a hole in the side of said hopper, and driven means disposed substantially horizontally at least partially across said hopper at a level within said hopper which is at or above said hole through which filter rods are supplied to said hopper for controlling the movement of filter rods within said hopper to maintain the upper surface of said filter rods in the hopper substantially level.

18. A filter rod feed according to claim 17, wherein said driven means comprises an agitator having a substantially horizontal row of laterally spaced bars mounted for reciprocating movement in a substantially horizontal direction and being disposed parallel to the filter rods in said hopper.

* * * * *